US005129553A

United States Patent [19]

Becker

[11] Patent Number: 5,129,553

[45] Date of Patent: Jul. 14, 1992

[54] AERATION DEVICE

[75] Inventor: William L. Becker, Chattanooga, Tenn.

[73] Assignee: The Heil Company, Brookfield, Wis.

[21] Appl. No.: 533,350

[22] Filed: Jun. 5, 1990

[51] Int. Cl.[5] ..... B65G 69/06

[52] U.S. Cl. ..... 222/195; 222/198; 137/854; 366/124

[58] Field of Search ..... 222/195, 196, 198; 134/167 R; 366/124, 106, 107, 342; 239/533.13, DIG. 12; 137/854, 860; 406/137

[56] References Cited

U.S. PATENT DOCUMENTS

| | | | |
|---|---|---|---|
| 3,424,352 | 1/1969 | Schlink | 222/195 |
| 3,713,564 | 1/1973 | Cottrell | 222/1 |
| 3,722,836 | 3/1973 | Savage et al. | 366/124 X |
| 3,754,740 | 8/1973 | Piper | 239/533.13 X |
| 3,929,261 | 12/1975 | Solimar | 222/195 |
| 3,952,956 | 4/1976 | Steele | 222/195 X |
| 4,030,755 | 6/1977 | Heimke | 222/195 X |
| 4,172,539 | 10/1979 | Botkin | 222/195 |
| 4,820,052 | 4/1989 | Krysel | 406/137 X |

FOREIGN PATENT DOCUMENTS

| | | | |
|---|---|---|---|
| 2174372 | 11/1986 | United Kingdom | 222/195 |

*Primary Examiner*—Donald T. Hajec
*Assistant Examiner*—Gregory L. Huson
*Attorney, Agent, or Firm*—McAndrews, Held & Malloy, Ltd.

[57] ABSTRACT

A flow cone aerator for assisting discharge of material from containers. The aerator includes an inverted cone shaped hollow support adapted to be affixed to a wall of the container with the small diameter end of the support adjacent the interior surface of the container and the large diameter end extending into the interior of the container. An air inlet is positioned adjacent the small diameter end and is adapted to be selectively connected to a pressurized source of air exteriorly of the container. At least one air outlet port radially extends through the wall of the support. A flexible cone shaped flap, corresponding in shape to the support, is mounted to the small diameter end of the support with the large diameter end of the flap free of attachment to the support. The flap flexes toward and away from the support to close and open, respectively, the outlet port and to permit the flow of air into the material stored in the container so as to aerate the material to facilitate the efficient pneumatic discharge of the material from the container.

7 Claims, 1 Drawing Sheet

FIG. 1
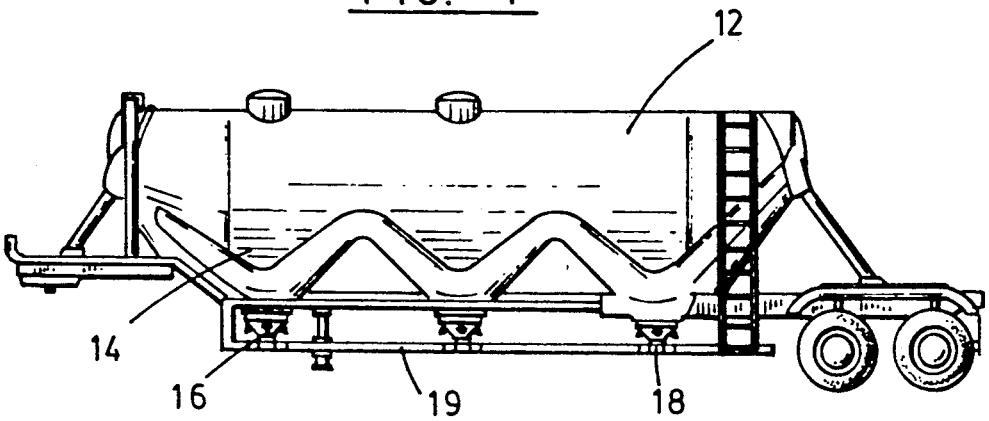
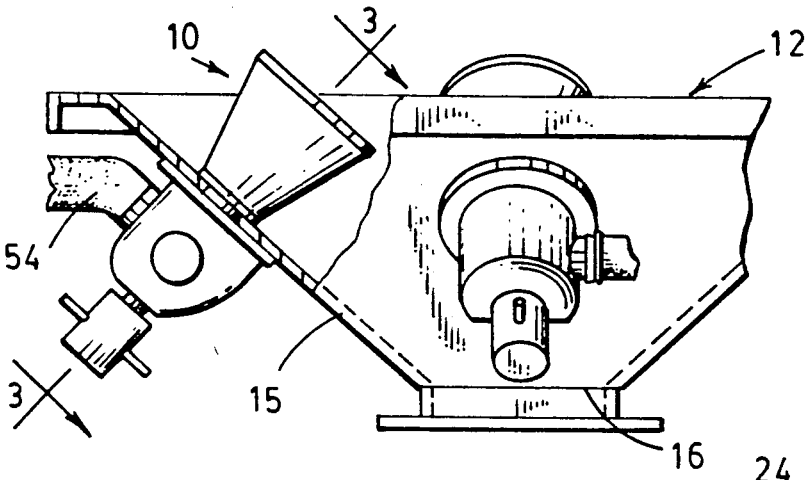
FIG. 2
FIG. 3
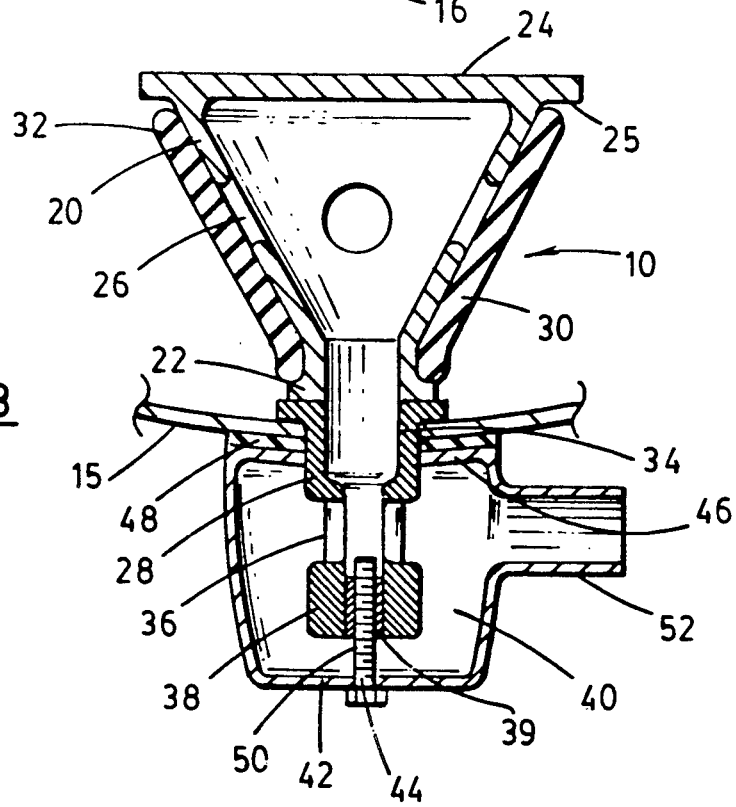

AERATION DEVICE

BACKGROUND OF THE INVENTION

The present invention relates to an improved flow cone aerator for the introduction of air into dry bulk material to fluidize the material for efficient pneumatic transfer. The improved aerator of the invention is used in pneumatic trailer tanks, rail cars, storage tanks and the like and functions as a check valve when used in relation to dry product storage.

Various aerators are known in the prior art for introducing air into containers to aerate materials stored in the containers. One such aerator in particular is disclosed in the U.S. Pat. No. 3,929,261 to Solimar. This aerator is cone shaped and is adapted to be affixed to a wall of the container, with the larger diameter end of the cone aerator adjacent the interior surface of the container and the small diameter end of the cone aerator extending into the interior of the container. The aerator includes an air outlet extending through the wall of the aerator and an air inlet adjacent the large diameter end. A cone shaped flap correspondingly shaped to the aerator is positioned over the aerator and closes the air outlet when in close fitting relation to the aerator. The large diameter end of the flap is free of attachment and flexes toward and away from the aerator to close and open the air outlet.

While the aerator just described works for the purpose intended, namely to aerate the contents of a container for pneumatic removal, a need for improvement became apparent through continued use of that aerator.

One of the problems associated with the above described aerator is that it directs the flow of air toward the container wall. After substantial use, the aeration air, especially when used to aerate abrasive and dusty materials, will establish channels in the aerator that are directed into the container wall, eventually blasting a hole in the container.

Another disadvantage is that care must be taken to properly install the large base of the aerator so that it fits the curvature of the container wall. Installation of the base, counter to the curvature, can easily occur if care is not exercised, resulting in clogged air lines from the materials entering the aerator between the base and the container wall.

SUMMARY OF THE INVENTION

The invention relates to an improved flow cone aerator for fluidizing materials in a container for subsequent pneumatic removal of the materials from the container. The aerator includes a hollow, substantially cone-shaped support having an air inlet positioned adjacent its small diameter end and a plurality of air outlets extending through the wall of the aerator into the interior of the container. The air inlet is adapted to be connected to a source of air outside of the container. A correspondingly shaped resilient flap member is mounted to the small diameter end of the support and flexes toward and away from the aerator to close and open the outlets during operation.

It is an object of the present invention to provide an improved cone aerator for fluidizing materials in a container which directs the flow of air into the container thereby eliminating the blasting of the materials against the container walls.

Another object of the invention is to provide an improved cone aerator which improves product aeration and stabilizes the unloading pressure, resulting in an unloading procedure that does not require constant surveillance or adjustment.

A further object of the invention is to provide an improved cone aerator which does not require orientation within the container.

Another object of the invention is to provide an improved cone aerator which comprises a cone shaped support member having a small diameter end and a large diameter end, and adapted to be affixed to a wall of a container, with the small diameter end adjacent the interior surface of the container wall and the large diameter end extending into the interior of the container, an air inlet positioned adjacent to the small diameter end and adapted to be selectively connected to a source of air outside of the container, at least one air outlet radially extending through the wall of the support member into the interior of the container, and a flexible, cone shaped flap correspondingly shaped to the support member and having a small diameter end mounted adjacent the small diameter end of the support member and a large diameter end free of attachment to the support member, so that the flap member can flex toward and away from the support member to close and open the air outlet to allow air to flow outward of the air outlet and toward the interior of the container to aerate material inside the container.

These and other objects and advantages of the invention will become apparent from the following description.

BRIEF DESCRIPTION OF THE DRAWINGS

FIG. 1 is a side view of a trailer tank on which an aerator according to the present invention may be mounted.

FIG. 2 is a perspective view, with portions broken away, of a tank hopper of the trailer tank of FIG. 1 having an aerator according to the present invention mounted therein.

FIG. 3 is a cross-sectional view of the aerator taken along the line 3—3 of FIG. 2.

DETAILED DESCRIPTION OF THE INVENTION

Referring to FIGS. 1 and 2, there is shown an improved flow cone aerator of the invention generally designated at 10 for fluidizing material in a tank hopper 12 to facilitate discharge of materials from the hopper. The hopper 12 has one or more generally conically shaped discharge areas 14 terminating at their lower ends in discharge openings 16. The discharge openings 16 lead into discharge control valves 18 which control the rate of discharge of material from the hopper 12 into a transversely extending discharge line 19.

The aerator 10 is mounted on the wall 15 of the conically shaped discharge area 14 of the hopper 12 above the discharge opening 16. It will be appreciated that a number of aeration devices 10 may be mounted in each discharge area 14 to insure adequate aeration of the product and uniform discharge through the discharge areas 14 and openings 16.

As illustrated in FIG. 3, the aerator 10 comprises a substantially cone shaped, (i.e. frustaconical) hollow support 20 having an open small diameter end 22 mounted to the inside wall of the hopper and a closed large diameter end 24 extending into the interior of the hopper. The large diameter end 24 includes side surfaces 25 that extend beyond the cone-shaped walls of the support 20. A plurality of aeration ports 26 extend radially through the wall of the support to permit fluidizing air into the interior of the tank hopper, as will hereinafter be described. The aeration ports 26 are preferably equidistantly spaced apart one from another. Although a different number of aeration ports may be provided, it has been found that four equidistantly spaced aeration ports provide optimum product fluidization, less pressure variations in the tank, and a pressure stable unloading condition resulting in more productive operation.

A substantially cone shaped flexible flap 30, corresponding in shape to the cone shaped support 20, is mounted to the small diameter end of the support so that the flap 30 is in close fitting overlying relationship with the cone shaped walls of the support 20. The flap 30 has an open, large diameter end 32 that is free from attachment to the support 20. The large diameter end 32 is adapted to flex toward and away from the support 20 to close and open the aeration ports 26 to control the flow of air into the tank hopper 12. Although the support 20 and the flexible flap 30 are described as substantially cone-shaped, it is contemplated that they may also take other geometric forms, so long as the flexible flap functions in conjunction with the support to direct the flow of air into the interior of the container.

The small diameter end 22 of the cone shaped support 20 communicates with a generally cylindrical hollow axial tubular extension 28. The axial extension is adapted to extend outwardly through an opening 34 in the hopper wall 15 to communicate with a pressurized air supply (not shown) exteriorly of the hopper. The axial extension 28 includes a plurality of air inlet openings 36 radially extending through the wall thereof to permit the flow of air from the air supply to the interior of the hollow support 20. The axial extension 28 has a lower end 38 provided with an internally threaded axial bore 39.

A cup shaped housing 40 is positioned adjacent to the outside wall 15 of the hopper and encloses the axial extension 28. The housing 40 has a bottom surface 42 with an axial opening 44 therethrough and a slightly concave upper surface 46 adapted to fit the curvature of the outside wall of the tank hopper. A sealing gasket 48 is positioned between the upper surface 46 and the outside wall 15 of the hopper to seal the housing relative to the hopper around the opening 34. The axial opening 44 is in axial alignment with the threaded axial bore 39, and a threaded screw 50 is slidably received through the axial opening 44 and threadably engaged with the internal threads of the axial bore 39 to securely draw the support 20 against the inside surface of the wall 15 of the tank hopper. A fitting 52 projects radially from one side of the housing 40 and is adapted to be connected to a conduit 54 which, in turn, communicates with the pressurized air supply.

In operation, a plurality of the aerators, according to the invention, are secured to a hopper filled with dry bulk material. The aerators are connected to the conduit 54 which is in communication with a suitable source of air under pressure. The discharge areas of the hopper are connected with the discharge line 19 and the flow of material from the hopper to the discharge line is controlled by the discharge control valves 18. Air flows through the conduit 54, into the axial extension 28, and the support 20, and out through the aeration ports 26 into the material in the interior of the hopper, causing the material to be effectively aerated. Once the material is in a thoroughly fluidized state, the discharge control valves 18 are opened to permit effective discharge of the dry bulk material into the discharge line 19.

The cone aerators of the invention direct the flow of air directly into the material, thus eliminating the channeling of materials against the hopper wall, as in prior art devices. Material aeration is improved by providing the support with four aeration ports rather than the conventional two ports, since the four port design tends to stabilize the unloading tank pressure. Stabilized unloading tank pressure is advantageous because it tends to result in an unloading procedure that does not require constant surveillance or adjustment. The aerators of the invention are also easier to install than prior art devices having a larger diameter support base, since a larger diameter support base must be oriented and installed to fit the curvature of the hopper wall to insure that there are no gaps between the support and the hopper wall where material can enter the support and clog the air lines. Such orientation is not required by the improved aerator of the invention because of its smaller diameter base.

It will be understood that the claims are intended to cover all changes and modifications of the preferred embodiments of the invention, which do not constitute a departure from the spirit and scope of the invention.

What is claimed is:

1. An improved flow cone aerator for aerating and assisting in the discharge of material stored within a container having a wall, the improved aerator, comprising:

an inverted substantially cone-shaped hollow support member having a small diameter end and a large diameter end, and adapted to be affixed to a wall of the container, with said small diameter end adjacent the interior surface of the container wall and said large diameter end extending into the interior of the container, an axial extension in communication with the small diameter end of said support member and adapted to project through an opening in the container wall, and be selectively connected to a pressurized source of air exteriorly of the container, at least one air outlet radially extending through the wall of said support member into the interior of the container, a flexible, cone-shaped flap correspondingly shaped to said support member and having a small diameter end mounted adjacent to the small diameter end of the support member and a large diameter end free of attachment to said support member, said flap being adapted for flexing movement toward and away from said support member to selectively close and open, respectively, said air outlet, whereby when said aerator is used, flow of air into said support member and through said air outlet induces flexing of said large diameter end of said flap away from said support member to allow flow of air outwardly relative to the axis of the support member and toward the interior of the container to aerate and thereby fluidize the material stored in the container to facilitate removal of the material from the container.

2. The improved aerator according to claim 1, wherein said aerator is mounted on the container wall with said axial extension projecting through an opening in the container wall to exterior of the container; and including fastening means, disposed outside of the container, for engaging with the axial extension to maintain the support member against the interior surface of the container wall.

3. The improved aerator device according to claim 2, wherein said fastening means comprises a cup-shaped member surrounding the axial extension, a threaded fastener extending through an opening in the cup-shaped member into threaded engagement with the axial extension to draw the cup-shaped member and the support member toward one another on opposite sides of the container wall and to maintain the support member against the interior surface of the container wall.

4. The improved aerator of claim 3 wherein said cup-shaped member is provided with an inlet fitting for receiving a source of air under pressure.

5. The improved aerator device of claim 3 wherein said fastening means includes an annular sealing gasket disposed between the cup-shaped member and the container wall to maintain the fastening means in sealed relation against the exterior surface of the container wall.

6. The improved aerator device of claim 1, wherein said support member is provided with four air outlets positioned radially around the longitudinal axis of said support member and equidistant from each other.

7. Improved flow cone aerator for aerating and assisting in the discharge of material stored within a container having a wall, the improved aerator, comprising an inverted substantially cone-shaped hollow support member having a small diameter end and a closed large diameter end, and adapted to be affixed to a wall of the container, with said small diameter end adjacent the interior surface of the container wall and said large diameter end extending into the interior of the container, an air inlet positioned adjacent to said small diameter end and adapted to be selectively connected to a pressurized source of air exteriorly of the container, at least one air outlet radially extending through the wall of said support member into the interior of the container, a flexible, cone-shaped flap correspondingly shaped to said support member and having a small diameter end mounted adjacent to the small diameter end of the support member and a large diameter end free of attachment to said support member, said flap being adapted for flexing movement toward and away from said support member to selective close and open, respectively, said air outlet, whereby when said aerator is used, flow of air into said support member and through said air outlet induces flexing of said large diameter end of said flap away from said support member to allow flow of air outwardly relative to the axis of the support member and toward the interior of the container to aerate and thereby fluidize the material stored in the container to facilitate removal of the material from the container.

* * * * *